US005195739A

United States Patent [19]

Watabe

[11] Patent Number: 5,195,739

[45] Date of Patent: Mar. 23, 1993

[54] APPARATUS FOR PREVENTING BILLS OR THE LIKE FROM BEING PULLED OUT

[75] Inventor: Masayuki Watabe, Iruma, Japan

[73] Assignee: Nippon Conlux Co., Ltd., Tokyo, Japan

[21] Appl. No.: 925,907

[22] Filed: Aug. 5, 1992

Related U.S. Application Data

[63] Continuation of Ser. No. 828,014, Jan. 30, 1992, abandoned.

[30] Foreign Application Priority Data

Feb. 1, 1991 [JP] Japan ..... 3-32213

[51] Int. Cl.[5] ..... B65H 29/40

[52] U.S. Cl. ..... 271/207; 271/181; 271/178; 271/213; 271/278; 194/203; 194/206

[58] Field of Search ..... 271/178, 180, 181, 189, 271/207, 213, 264, 272, 274, 278; 194/203, 206, 207; 109/24.1; 232/15, 16

[56] References Cited

U.S. PATENT DOCUMENTS

| | | | |
|---|---|---|---|
| 3,149,254 | 9/1964 | Carter et al. | 310/12 |
| 3,924,847 | 12/1975 | Pescetto | 271/3 |
| 3,937,926 | 2/1976 | Jones et al. | 235/61.7 R |
| 4,091,271 | 5/1978 | Jones et al. | 235/419 |
| 4,414,594 | 11/1983 | Farmer et al. | 360/106 |
| 4,678,072 | 7/1987 | Kobayashi et al. | 194/206 |
| 4,784,274 | 11/1988 | Mori et al. | 209/534 |
| 4,807,736 | 2/1989 | Kondo et al. | 194/206 |
| 4,809,966 | 3/1989 | Kobayashi et al. | 271/181 |
| 4,809,967 | 3/1989 | Kondo | 271/181 |
| 4,858,744 | 8/1989 | Dolejs et al. | 194/206 |
| 4,880,096 | 11/1989 | Kobayashi et al. | 194/206 |
| 5,005,688 | 4/1991 | Yukimoto et al. | 194/206 |

FOREIGN PATENT DOCUMENTS

| | | |
|---|---|---|
| 0091112 | 10/1983 | European Pat. Off. . |
| 0326374 | 8/1989 | European Pat. Off. . |
| 56-145770 | 11/1981 | Japan . |
| 57-110069 | 7/1982 | Japan . |
| 59-223887 | 12/1984 | Japan . |
| 62-114459 | 5/1987 | Japan . |
| 62-173968 | 7/1987 | Japan . |
| 62-229531 | 10/1987 | Japan . |
| 2-018751 | 1/1990 | Japan . |
| 2-023058 | 1/1990 | Japan . |
| 2-65647 | 8/1990 | Japan . |

*Primary Examiner*—H. Grant Skaggs
*Assistant Examiner*—Carol Lynn Druzbick
*Attorney, Agent, or Firm*—Spensley Horn Jubas & Lubitz

[57] ABSTRACT

An apparatus for preventing a bill from being pulled out. The apparatus includes a hang preventing mechanism which has a tongue for preventing a bill from hanging from a bill accumulating box into a bill passage. The bill is conveyed through the bill passage to the bill accumulating box. The hang preventing mechanism is pivotally supported and is spring biased by a biasing mechanism for holding the tongue to prevent a bill, received in the bill accumulating box, from hanging from the bill accumulating box while the tongue is allowed to turn by a bill which passes through the bill passage for entering the bill accumulating box.

4 Claims, 7 Drawing Sheets

APPARATUS FOR PREVENTING BILLS OR THE LIKE FROM BEING PULLED OUT

This is a continuation of application Ser. No. 828,014 filed on Jan. 30, 1992, now abandoned.

BACKGROUND OF THE INVENTION

1. Field of the Invention

The present invention relates to an apparatus for preventing a bill or the like sheet from being pulled out from a bill processing machine such as an automatic vending machine and a money exchanger. In this specification and the claims, the term "bill" is referred to a paper money and the like valuable sheet material.

2. The Prior Art

Generally, such a money processing machine is provided with a bill or paper money discriminating unit and a bill accumulating unit. The discriminating unit discriminates an inserted genuine bill from a counterfeit one, and the bill accumulating unit accumulates only genuine bills accepted in a bill accumulating box. Bills are conveyed by means of conveyor belts or the like device from an inlet slot along a bill passage to the bill accumulating box. During this transportation, it is judged by the bill discriminating unit whether or not the bill inserted is genuine or counterfeit. Conventionally, a shutter plate is provided to block the bill passage for the purpose of preventing a genuine bill, which has passed the discriminating unit, from being drawn back to the bill inlet slot by an illegal act.

However, in the bill processing machine according to the conventional apparatus, the shutter plate may be manually retreated by inserting an elongated thin plastic plate into the bill passage through the bill inlet slot. Thus, there is a problem in that when a bill with a tape bonded to the trailing end thereof is inserted and accepted as a genuine bill in the apparatus, the shutter plate is retreated in such a manner, and then the bill is liable to be drawn back by pulling the tape.

SUMMARY OF THE INVENTION

Accordingly, it is an object of the present invention to provide an apparatus of preventing bills from being pulled out, in which the bills which have been received in the bill accumulating box are prevented from being pulled out by inserting a thin plate, such a plastic plate, from a bill inlet slot along a bill passage.

To accomplish this and other objects, the present invention provides an apparatus for preventing a bill from being pulled out, in which a bill inserted from a bill inlet is judged as to whether or not it is genuine, and only a genuine bill is passed into a bill accumulating box through a bill passage, the apparatus comprises pull out preventing means, arranged in the bill passage, for preventing a bill from being pulled out from the bill accumulating box, the pull out preventing means including: pull out preventing levers each including a pawl; hang preventing means including a tongue for preventing a bill from hanging from the bill accumulating box into the bill passage; supporting means for pivotally supporting the pull out preventing levers and the hang preventing means, the pawl of each pull out preventing lever being arranged to traverse the bill passage to block a bill, received in the bill accumulating box from returning to the bill inlet; first biasing means for spring biasing the pull out preventing levers toward the bill passage to block a bill, received in the bill accumulating box from returning to the bill inlet while allowing the pull out preventing levers to turn by a bill which passes through the bill passage for entering the bill accumulating box; and second biasing means for spring biasing the hang preventing means to prevent a bill, received in the bill accumulating box, by means of the tongue from hanging from the bill accumulating box, while allowing the tongue to turn by a bill which passes through the bill passage for entering the bill accumulating box.

DETAILED DESCRIPTION OF THE PREFERRED EMBODIMENT

Figure 1:
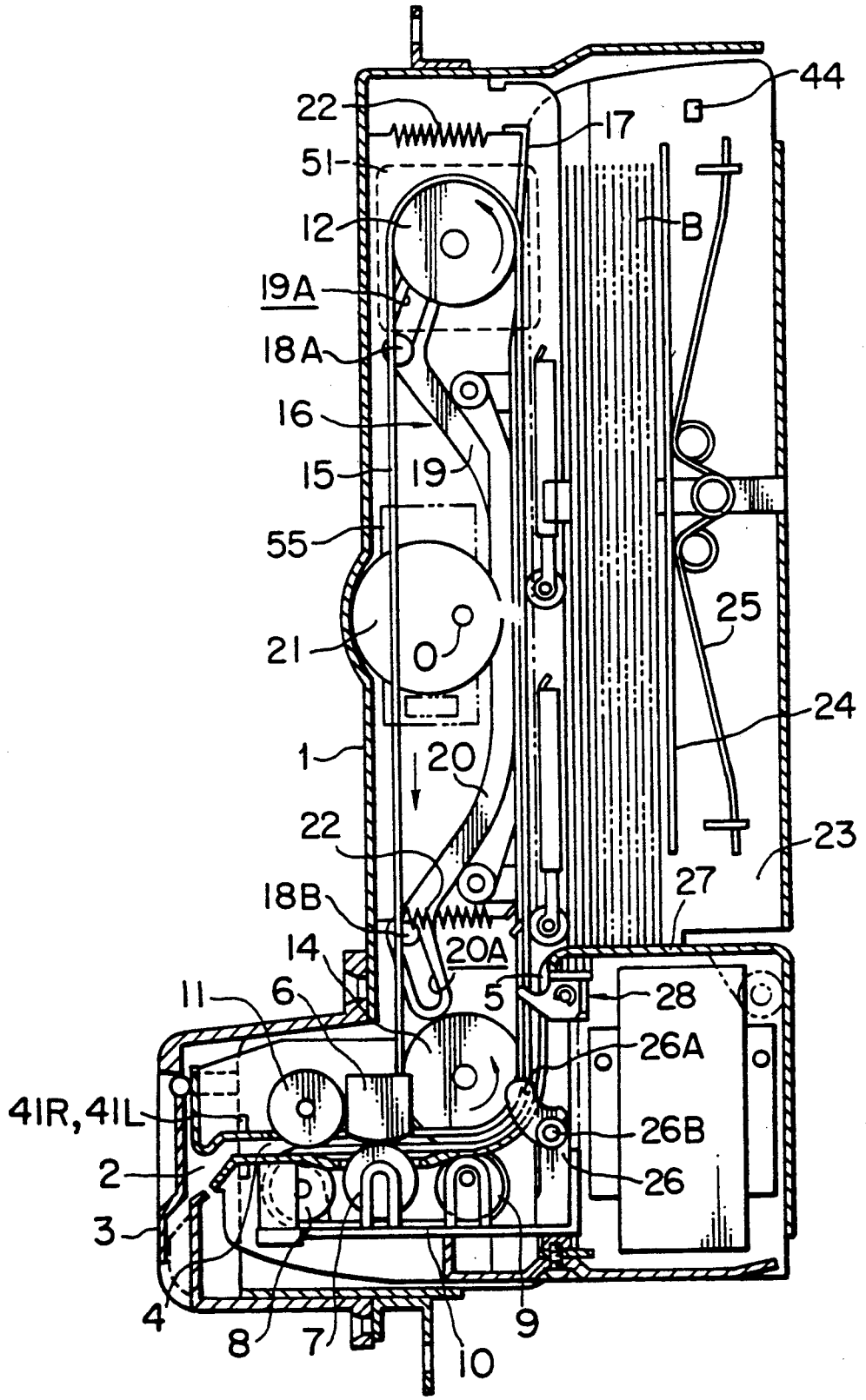
FIG. 1 is a vertical sectional view of a bill processing apparatus according to the present invention.

FIG. 1 is a vertical section of a bill processing system to which the present invention is applied. The bill processing system includes a housing 1, which has a bill insertion slot 2 formed through the front wall thereof. A bill is allowed to be inserted into the bill insertion slot 2 when a cover 3 is swung upwards. Within the housing 1 there are provided a horizontal bill passage 4 and a vertical bill passage 5 which communicates to the horizontal bill passage 4 in an L shape. The horizontal bill passage 4 is formed to communicate to the bill insertion slot 2. As means for discriminating counterfeit bills from genuine bills, a magnetic head 6 is arranged on the upper side of the horizontal bill passage 4. A head pinch roller 7 is arranged to oppositely face the magnetic head 6. Pulleys 8 and 9 are disposed upstream and downstream of the pinch roller 7, respectively. An endless belt 10 extends in a parallel fashion between and around the pulleys 8 and 9. The belt 10 is moved by movement of an endless belt 15 which extends around a driven pulley 14 since the pulley 9 is in contact with the belt 15. A pinch roller 11 presses the pulley 8 through the belt 10.

On one side or front side of the vertical bill passage 5, there are provided a pair of drive pulleys 12 and 12 at a horizontal distance although only one drive pulley 12 is shown. The drive pulleys 12 and 12 are rotated by the conveying motor 51. A pair of driven pulleys 14 and 14 are arranged at a lower portion of the housing 1 to correspond to the drive pulleys 12 and 12, respectively, and thereby two pairs of drive pulleys 12 and driven pulleys 14 are provided. An accumulating belt 15 extends in a parallel manner between and around each pair of the drive pulley 12 and the driven pulley 14. Adjacent to the accumulating belt 15 there is provided a bill stacker unit 16, which includes a pushing plate 17, a pair of links 19 and 20, and an eccentric cam 21. The pushing plate 17 is adapted to push backwardly a bill B which has been conveyed along the vertical bill passage 5 to a stacking position. Each of the links 19 and 20 is pivotally attached at its one end to the front surface of the pushing plate 17, and is slidably mounted at the other end to a fixed shaft 18A, 18B which passes through a slot 19A, 20A form through the link. The eccentric cam 21 is mounted on an output shaft of a stack motor unit 55 to rotate around a rotation center O. The pushing plate 17 is spring biased toward the bill stacker unit 16 by a pair of coil springs 22 and 22. On the other side of the vertical bill passage 5, there is provided an accumulating box 23 which accumulates in it bills B urged toward it by the bill stacker unit 16. A compressing plate 24 is arranged within the accumulating box 23 and is urged forwardly or to the left in FIG. 1 by a spring bar 25.

In the connected area between the horizontal bill passage 4 and the vertical bill passage 5 there is provided a shutter plate 26, which is pivotally mounted to the housing 1 through a pivot 26B. The shutter plate 26 is spring biased in the counterclockwise direction in FIG. 1, and normally closes or blocks the vertical bill passage 5 at its distal end 26A as shown. Thus, the shutter plate 26 is rotated in the clockwise direction by a bill B, which is being transported to the accumulating box 23 in a bill receiving direction, so that the shutter plate 26 is automatically retracted away from vertical bill passage 5. This causes a shutter switch 53 (FIGS. 7–10) to be turned on. On the other hand, the shutter plate 26 serves as a stopper to a bill B which is moving in the opposite direction or toward the bill inlet slot 2.

Figure 2:
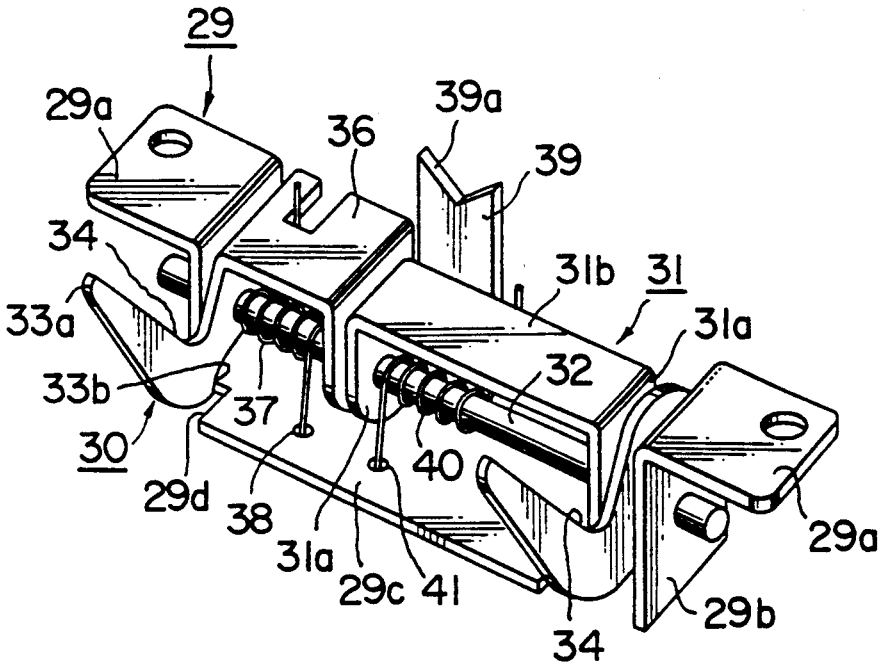
FIG. 2 is an enlarged perspective view of the pull out preventing unit in FIG. 1.
Figure 3:
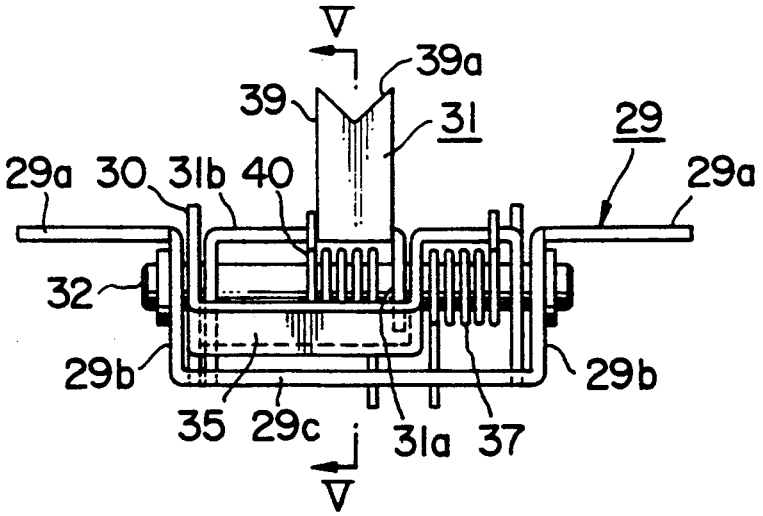
FIG. 3 is front view, reduced in scale, of the pull out preventing unit of FIG. 2.
Figure 4:
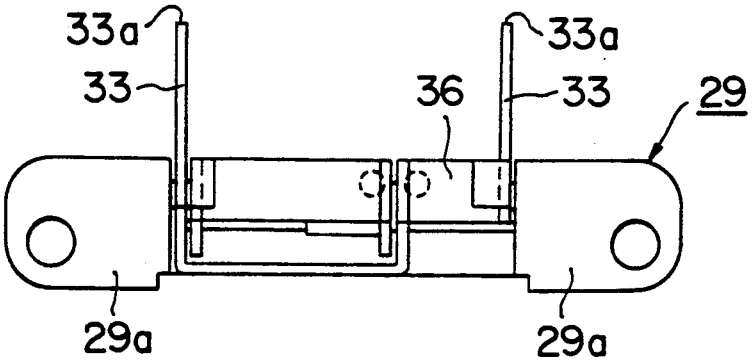
FIG. 4 is a plan view of the pull out preventing unit of FIG. 3.

The accumulating box 23 is provided with a bottom plate 27. A pull out preventing unit 28 is arranged below the bottom plate 27. The pull out preventing unit 28 includes, as shown in FIG. 2, an upwardly opening channel-shaped bracket 29, a pull out preventing lever 30, a bill hang preventing lever 31, and a pivotal shaft 32 which pivotally connecting the pull out preventing lever 30 and the bill hang preventing lever 31 to the bracket 29. The bracket 33 includes a pair of attaching flanges **29*a* and 29*a*, a pair of opposing side bearing plates 29*b* and 29*b*, and a bottom plate 29*c* which integrally interconnects the side bearing plates 29*b* and 29*b*. The bottom plate 29*c* is provided in each of opposite end portions of the front edge thereof with an engaging slot 29*d***.

The pull out preventing lever 30 has a pair of pawls 33 and 33 which are integrally connected through a connecting plate 35. Each of the pawls 33 and 33 extends diagonally upwards to define a hook groove 34 in the upper edge thereof. The pull out preventing lever 30 is arranged so that the pawls 33 and 33 extend away from the bill insertion slot 2. The connecting plate 35 has an inverted-L shaped spring engaging portion 36 integrally formed at the upper flange thereof with the left pawl 33 in FIG. 2. A first spring 37 is fitted around a pivotal shaft 32, and one end thereof engages with the spring engaging portion 36 whereas the other end is inserted into a spring holding hole 38. The pull out preventing lever 30 is spring biased the first spring 37 in the clockwise direction in FIG. 5 or in the direction to project the tip **33*a* of each pawl 33 forwardly. The tip 33*a* of each pawl 33 is placed at the maximum projection position when the pawl 33 is brought into engagement with the edge of the corresponding engaging groove 29*d* of the bottom plate 29*c* of the bracket 29**.

Figure 6:
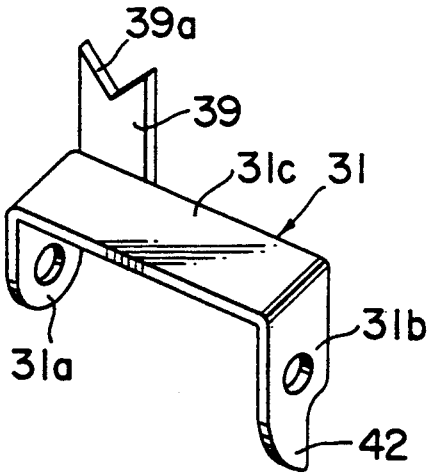
FIG. 6 is a perspective view of the bill hang preventing lever of FIG. 2.

As clearly shown in FIGS. 2 and 6, the bill hang preventing lever 31 is provided with a channel-shaped pivotally supported portion which includes a pair of bearing eye portions **31*a* and 31*b* and an interconnecting plate 31*c* interconnecting the bearing eye portions 31*a* and 31*b*. The pivotal shaft 32 passes through the bearing eye portions 31*a* and 31*b*. The interconnecting portion 31*c* has a tongue 39 integrally and vertically formed with a portion thereof close to the spring engaging portion 36 of the pull out preventing lever 30. The tongue 39 effectively prevents lower edges of bills received in the accumulating box 23 from suspending into the vertical bill passage 5. A second spring 40 is wound around the pivotal shaft 32, and one end thereof is inserted into a spring holding hole 41 formed through the bottom plate 29*c* of the bracket 29 whereas the other end is engaged with the rear edge of the interconnecting plate 31*c*. The bill hang preventing lever 31 is spring biased by the second spring 40 to direct the tongue 39 normally upwardly. The eye portion 31*b* is provided with a stopper 42 which holds the tongue 39 in the vertical position in FIG. 2 by abutting against the edge of the engaging groove 29*d* remote from the tongue 39**.

Further as shown in FIG. 1, inlet sensors 41R and 41L are arranged just behind the bill insertion slot 2 to detect a bill inserted. The reference numeral 44 designates a stacker switch which detects whether or not the accumulating box 23 is set in position.

Figure 11:
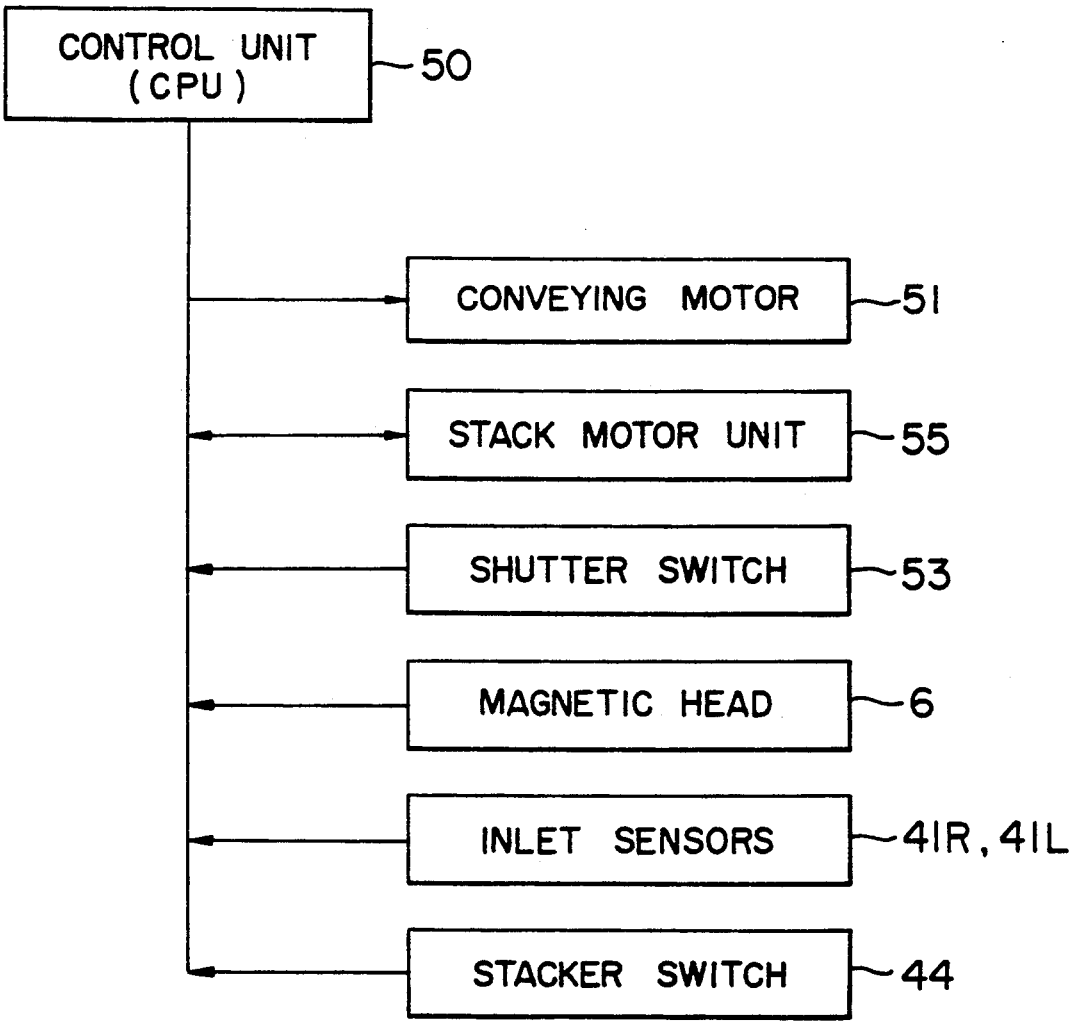
FIG. 11 is a block diagram of a control system of the apparatus of FIG. 1.

The bill pull out preventing apparatus is provided with a control unit 50 (FIG. 11), which includes a conventional central processing unit (CPU) and a read only memory (ROM) with a control program stored in it.

Figure 12:
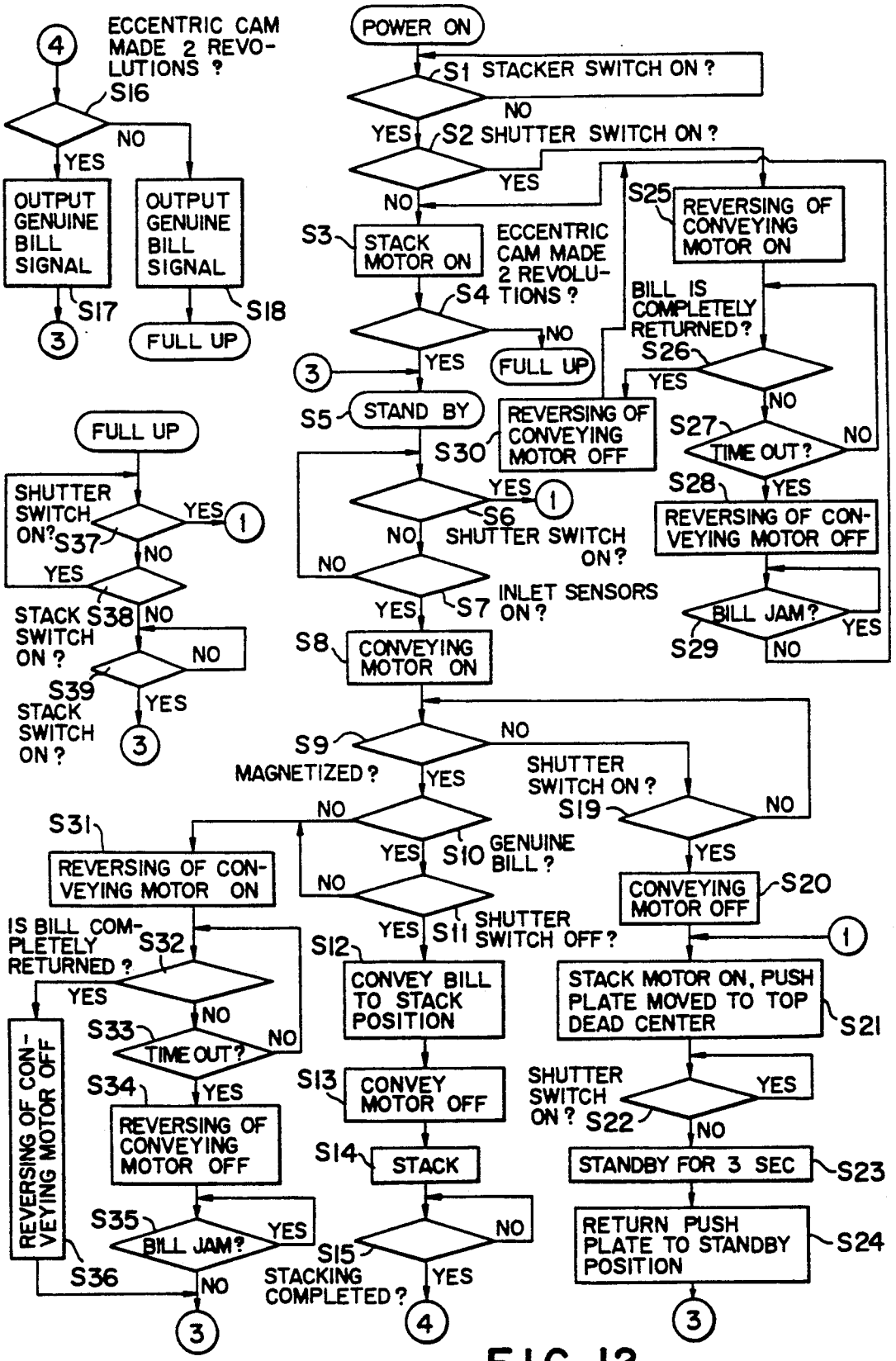
FIG. 12 is a flow chart illustrating bill pull out preventing operation of the apparatus of FIG. 1.

Now, referring to FIG. 12, the routine of preventing bills from being pulled out will be illustrated.

Firstly, when the stacker switch 44 is on (step S1) and the shutter switch 53 is off (step S2) after the power is turned on, according to the program of the ROM the CPU instructs the stack motor unit 55 to be energized (step S3). The CPU is placed in a standby state after the eccentric cam 21 made two revolutions (steps S4 and S5). When in the step S4 the eccentric cam 21 does not makes two revolutions, it is presumed that the accumulating box 23 is full up. Thus, necessary steps, such as bill receipt prohibition, are executed. In the step S4 it is judged whether or not the accumulating box 23 is full up of bills when the power is turned on. Although it is possible to push and accumulate bills in the accumulating box 23 by one revolution of the eccentric cam 21, in this embodiment the eccentric cam 21 is made two revolutions to positively place bills in the accumulating box 23. These revolutions are detected by a signal from the stack motor unit 55. When the shutter switch 53 is on in the step S2, it is liable that a bill is still left in the bill passage within the discriminating unit. In this event, the CPU controls so that the conveying motor 51 is reversed (step S25) to return the remaining bill to the bill insertion slot 2. When the bill is completely placed back to the bill insertion slot 2, the inlet sensors 41R and 41L send signals to the CPU, and then the CPU stops reversing of the motors (step S30), and thus the CPU returns to the step S3. When the bill is not returned, the check of the step S26 is repeated for about 3 seconds (steps S26 and S27). After lapse of 3 seconds, the reversing of the conveying motors is stopped (step S28). After the stopping of the motors, the CPU judges whether or not there is a jam of a bill or bills (step S29). This judgement is repeated until the jam is removed, and when the jam is removed, the CPU returns to the step S3.

When in the standby state, the shutter switch 53 is not on (step S6), the CPU goes to the step S7, where it is judged based on signals sent from the inlet sensors 41R and 41L whether or not the inlet sensors 41R and 41L are tuned on. When a bill B is inserted into the bill insertion slot 2, the inlet sensors 41R and 41L detect this and turn on, and then the conveying motors 51 is energized to introduce the inserted bill B into the bill passages 4 and 5 by the belts 10 and 15 (step S8).

When the shutter switch 53 is turned on in the step S6, it is presumed that an illegal action was taken, and the CPU enters a routine 1 and goes to the step S21. In the step S21, the CPU energizes the stack motor 55 to rotate the eccentric cam 21 to the top dead center and thereby the pushing plate 17 is raised to the top dead center position. When the shutter switch 53 is still on, the pushing plate 17 is kept urging the accumulated bills of the accumulating box 23 in the top dead center state against the compressing plate 24 which is spring biased to the left in FIG. 1 by the spring bar 25.

When the illegal action is stopped, the shutter plate 26 causes the shutter switch 53 to be turned off, and thus the CPU goes from the step S22 to the step S23. After about three seconds, in the step S24 the CPU energizes stack motor 55 to rotate the eccentric cam 21 so as to return the pushing plate 17 to the standby state with the eccentric cam 21 placed at the bottom dead center (FIG. 1). Thus, the CPU returns to the standby state in the step 5 of the routine 3.

The illegal action may be conducted by the following procedures: a genuine bill having a tape attached to its one end is inserted to the bill processing machine; the bill is stacked in the accumulating box 23 in the routine of steps S7 to S17; and then it is tried to draw back the bill by pulling the tape. More specifically, to retract the shutter plate 26 from the bill passage, a thin plastic plate or the like plate is inserted through the bill inlet slot 2 to push the shutter plate (the shutter switch 53 is turned on). In this state, it is tried to draw back the bill by pulling the tape.

According to the present invention, after the step S5, the CPU receives a signal representing that the shutter switch 53 is on or off, and when the shutter switch 53 is on, the CPU executes procedures of steps S20 to S24. The stacked genuine bill with the tape is urged by the pushing plate 17 to the top dead center position due to the rotation of the eccentric cam 21, and hence it is not possible to draw back the bill.

Returning to illustration of the normal route after the conveying motors are energized in the step S8, it is detected by the magnetic head 6 whether or not the bill is magnetized when the leading end of the bill reaches the magnetic head 6. When the bill is magnetized, according to a signal from the magnetic head 6 the CPU judges for the first stage that the bill is genuine (step S9), and then the bill is transported further to reach the shutter switch 53. The bill turns and keeps the shutter switch 53 on, during which the CPU judges whether or not the bill has a magnetic pattern of the genuine bill (step S10). When in this step an affirmative result is obtained, the bill is transported to and stopped at the stack position (steps S12 and S13) after the bill passes the shutter plate 26 causing the shutter switch 53 to be turn off.

When in the step S10 it is judged that the bill is not genuine, the conveying motors are reversed to return the bill to the bill insertion slot 2 as in the steps S25 to S30 (steps S31 to S36).

On the other hand, after the conveying motors are stopped in the step S13, the CPU energizes the stack motor unit 55 to rotate the eccentric cam 21, and thereby the bill is stacked (step S14). When the eccentric cam 21 makes two revolutions after the stack operation (steps S15 and S16), the CPU outputs a genuine bill signal (step S17), and returns to the standby state. In the case where in the step S16 it is detected that the eccentric cam 21 did not make two revolutions, the CPU judges that the accumulating box 23 is full up, and takes necessary steps such as prohibition of receiving of bills.

When in the step S9 the magnetic head 6 outputs a signal representing that the bill is not magnetized, it is likely that a nonmagnetic plastic plate or the like is inserted into the bill passage for illegally pulling out a bank. Furthermore, when the shutter switch 53 is turned on, that is, when the shutter switch 53 is turned on by a nonmagnetic insert (step S19), the CPU stops the conveying motors (step S20). Subsequently, the CPU energizes the stack motor unit 55 to rotate the eccentric cam 21, thereby urging the pushing plate 17 to the top dead center position toward the accumulating box 23 (step S21).

Until the shutter switch 53 is turned off, this state is held (step S22). When the shutter switch 53 is turned off, that is, when the insert is drawn out, a negative result is obtained in the step S22, and then after about 3 seconds (step S23), in the step S24 the CPU controls the stack motor 55 to rotate the eccentric cam to return the pushing plate 17 to the normal standby position (as shown in FIG. 1).

There is a possibility that when the accumulation box 23 is full of bills, a thin plastic plate or the like is illegally inserted from the bill insertion slot 2 into the bill passage 4. For example, the accumulating box 23 may become full up when a genuine bill having a tape attached to it is inserted. In this event, to pull out the bill the bill passage may be released by retracting the distal end 26A of the shutter plate 26 with the inserted thin plate. This causes the shutter switch 53 to turn on, and the CPU goes to the step S21, and then as already described the stack motor unit 55 is energized to rotate the eccentric cam 21, and thereby the pushing plate 17 is pushed into the accumulating box 23, and is held in this position. When the shutter switch 53 is off in the step S37, on the basis of a signal sent from the stacker switch 44 the CPU makes a judgement as to whether or not the stacker switch 44 is on or off (step S38). When the stacker switch 44 is off, the accumulating box 23 is removed and the bills stacked in it are taken out. Then, the accumulating box 23 is set in position again. After receipt of a signal representing that the stacker switch is on (step S39), the CPU returns to the standby state (step S5).

Referring to FIGS. 7 to 10, it will be described how the bill pull out preventing apparatus prevents pulling out of a bill by an illegal action such that a genuine bill B with a tape T attached to its trailing end is accepted and then it is tried to draw back the bill.

Figure 5:
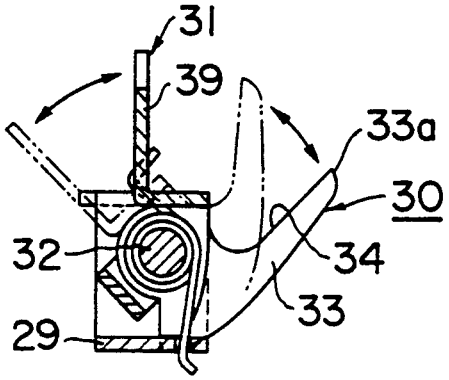
FIG. 5 is a sectional view taken along the line V—V in FIG. 3.
Figure 7:
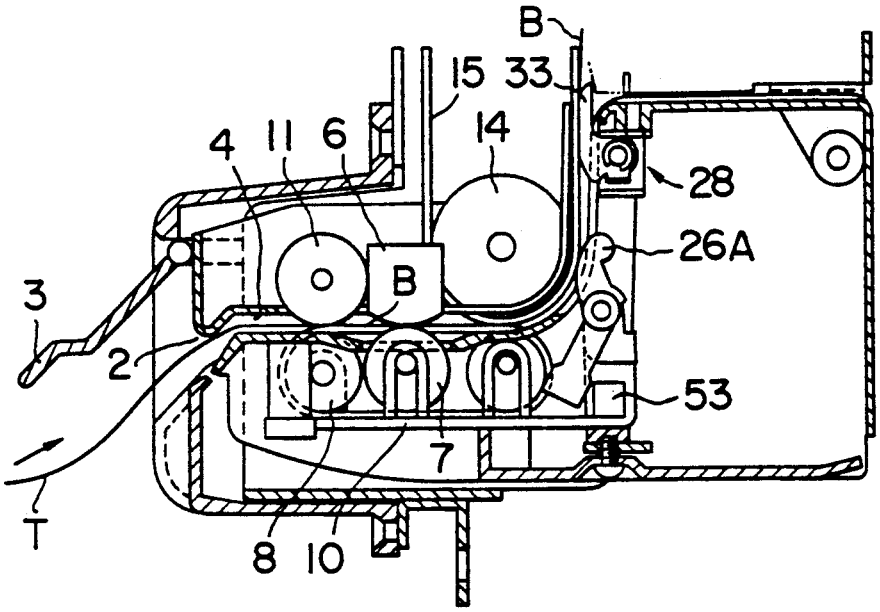
FIG. 7 is an enlarged fragmental vertical sectional view of the bill processing apparatus of FIG. 1, in which a bill with a tape is inserted.
Figure 8:
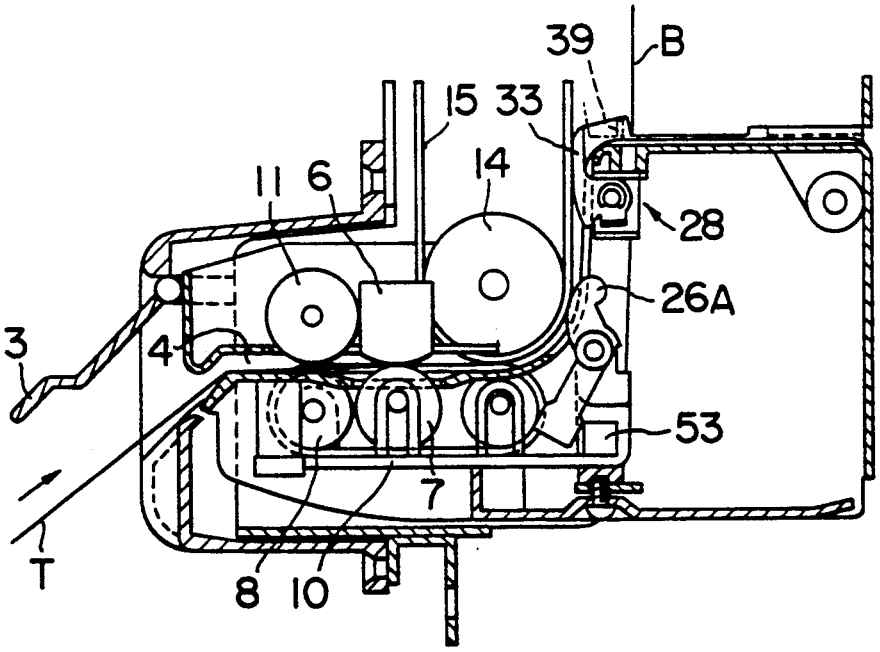
FIG. 8 is an enlarged fragmental vertical sectional view of the bill processing apparatus of FIG. 1, illustrating a state just after the bill with the tape was received in the bill accumulating box.

In FIG. 7, the genuine bill B with the tape T is inserted into the bill passage 4 through the bill inlet slot 2 as in the usual case, and the magnetic head 6 sends a signal representing the bill B is genuine. Subsequently, the bill B is conveyed in the bill passage 4, pushing the projecting end 26A of the shutter plate 26 outside the bill passage 4, and then the bill B pushes the pull out preventing levers 30 to retract against the spring force of the coil spring 37, and is thus introduced into the bill passage 5 (FIG. 7). When the bill B reaches to the stack position where it faces the pushing plate 17, the conveying of the bill B is stopped, and the eccentric cam 21 makes two revolutions, so that the pushing plate 17 makes two reciprocal movements. During the backward movement of the pushing plate 17, the pushing plate 17 turns the bill hang preventing lever 31 against the coil spring 40 by the lower end thereof in the counterclockwise direction as shown in FIG. 5. In this state, the pushing plate 17 pushes the bill B into the accumulating box 23 against the compressing plate 24 (FIG. 8). Although the pushing plate 17 may make a single reciprocal movement by a revolution of the eccentric cam 21, it is preferable to make the pushing plate two reciprocal movements as in this embodiment to positively accumulate bills.

Figure 9:
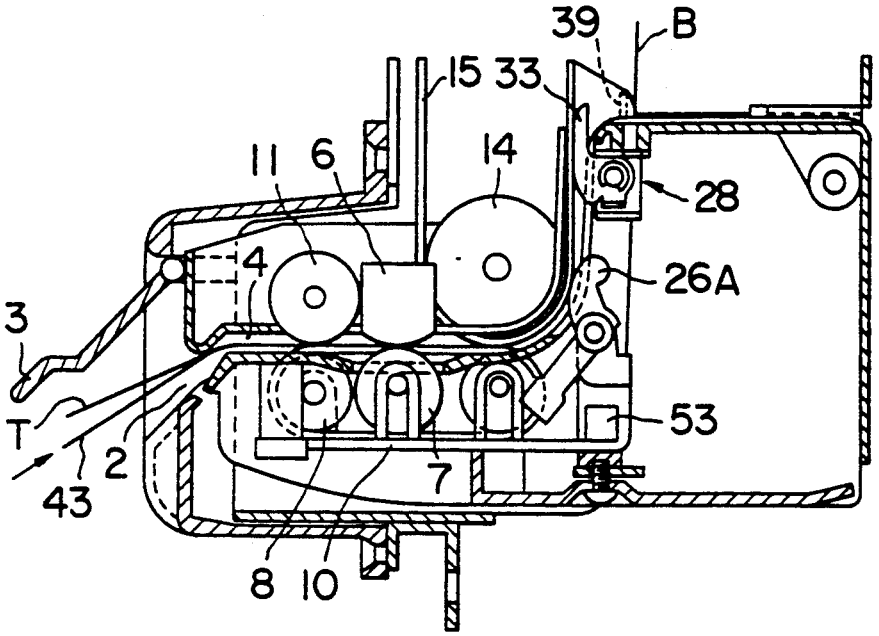
FIG. 9 is an enlarged fragmental vertical sectional view of the bill processing apparatus of FIG. 1, in which a plastic plate is inserted.
Figure 10:
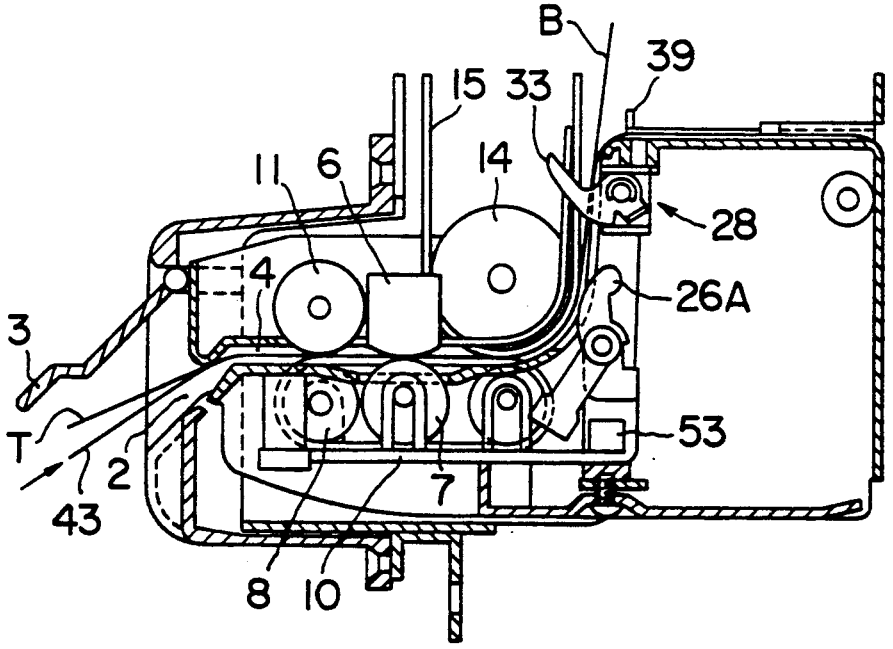
FIG. 10 is an enlarged fragmental vertical sectional view of the bill processing apparatus of FIG. 1, in which the bill is being drawn back.

In the case where as shown in FIG. 9 it is tried to pull out the bill B by moving the projecting end 26A of the shutter plate 26 away from the bill passage with a plastic plate 43 which has been inserted through the bill inlet slot 2, the lower end of the bill B is brought into engagement with the hook grooves 34 of the pull out preventing lever 30, and thereby pulling out of the bill B is prevented.

In the case where an illegal user inserts the plastic plate 43 further and tries to draw out the bill B by retracting the pawls 33 of the pull out preventing lever 30 with the plastic plate 44, the bill B is hooked at the lower edge thereof by the tongue 39. The bills B are thus prevented from being pulled out by the tape T. When the illegal user tries to draw out the tape T by force, the tape T is cut by the V-shaped edge 39*a* of the tongue 39. Should the bill B pass over the tongue 39 by pulling the tape T, the bill B is hooked by the hooking grooves 34 of the pull out preventing lever 30.

What is claimed is:

1. An apparatus for preventing a bill from being pulled out, in which a bill inserted from a bill inlet is judged as to whether or not it is genuine, and only a genuine bill is passed into a bill accumulating box through a bill passage, the apparatus comprises pull out preventing means, arranged in the bill passage, for preventing a bill from being pulled out from the bill accumulating box, the pull out preventing means including:

pull out preventing levers each including a pawl;

hang preventing means including a tongue for preventing a bill from hanging from the bill accumulating box into the bill passage;

supporting means for pivotally supporting the pull out preventing levers and the hang preventing means, the pawl of each pull out preventing lever being arranged to traverse the bill passage to block a bill, received in the bill accumulating box from returning to the bill inlet;

first biasing means for spring biasing the pull out preventing levers toward the bill passage to block a bill, received in the bill accumulating box, from returning to the bill inlet while allowing the pull out preventing levers to be turned by a bill which passes through the bill passage for entering the bill accumulating box; and second biasing means for spring biasing the hang preventing means to prevent by way of the tongue a bill, received in the bill accumulating box, from hanging from the bill accumulating box, while allowing the tongue to be turned by a bill which passes through the bill passage for entering the bill accumulating box.

2. An apparatus as recited in claim 1, wherein the supporting means comprises a bracket and a pivotal shaft pivotally supported on the bracket; and the pull out preventing levers and the hang preventing means are pivotally supported on the pivotal shaft.

3. An apparatus as recited in claim 2, wherein the hang preventing means is spring biased by the second biasing means so that the tongue is normally vertically placed.

4. An apparatus as recited in claim 3, wherein the second biasing means comprises a coil spring wound around the pivotal shaft.

* * * * *